United States Patent [19]

Fujiwara et al.

[11] Patent Number: 4,469,000

[45] Date of Patent: Sep. 4, 1984

[54] SOLENOID DRIVING APPARATUS FOR ACTUATING KEY OF PLAYER PIANO

[75] Inventors: Yuji Fujiwara, Hamamatsu; Shigeru Muramatsu, Mori; Mitsuhiko Mori; Takamichi Sawase, both of Hamamatsu, all of Japan

[73] Assignee: Nippon Gakki Seizo Kabushiki Kaisha, Hamamatsu, Japan

[21] Appl. No.: 443,435

[22] Filed: Nov. 22, 1982

[30] Foreign Application Priority Data

Nov. 26, 1981 [JP] Japan ..... 56-189441

[51] Int. Cl.[3] ..... G10F 5/00

[52] U.S. Cl. ..... 84/115; 84/1.1; 84/DIG. 7

[58] Field of Search ..... 84/1.09, 1.1, 1.27, 84/115, DIG. 7

[56] References Cited

U.S. PATENT DOCUMENTS 4,132,141 1/1979 Campbell et al. ..... 84/1.27 X 4,351,221 9/1982 Starnes et al. ..... 84/1.27 X

*Primary Examiner*—William B. Perkey

*Attorney, Agent, or Firm*—Spensley Horn Jubas & Lubitz

[57] ABSTRACT

A solenoid driving apparatus for actuating keys of a player piano is provided in which respective key striking strength data can be applied to respective solenoids of keys, so that musical tones can be reproduced correctly and in which the key striking strength data at the time of musical performance can be compensated for high fidelity reproduction. The solenoid driving apparatus includes a plurality of keys and solenoids provided on each key. When a key is depressed, a first key striking strength data corresponding to key striking strength and a data designating the depressed key are generated. The first key striking strength data is then converted into a second key striking strength data so as to make the latter data in linear proportion to an operating or response speed of the solenoid. In accordance with the second key striking strength data, a solenoid driving data is generated, and is applied to the solenoid corresponding to the key designated by the designating data. The solenoid driving data thus converted from the second key striking strength data causes musical tones to be reproduced as having correct timings and high fidelity.

9 Claims, 20 Drawing Figures

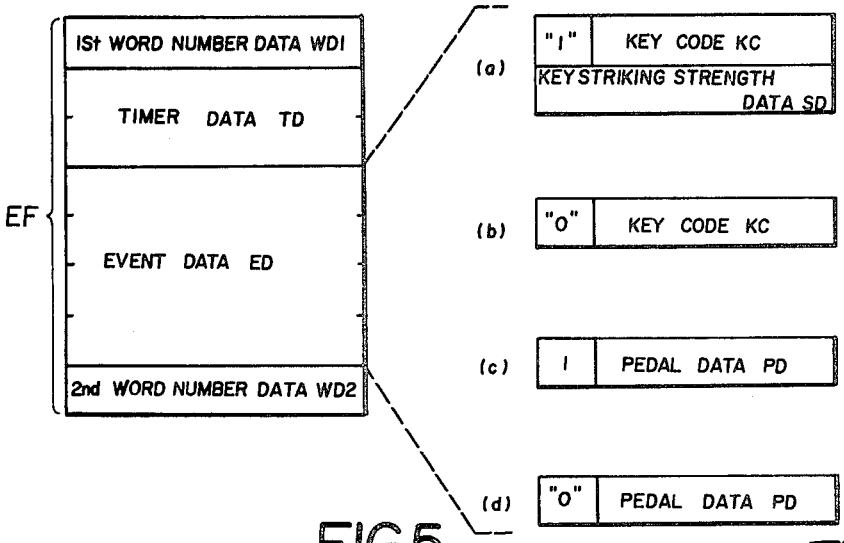
FIG.5
FIG.6
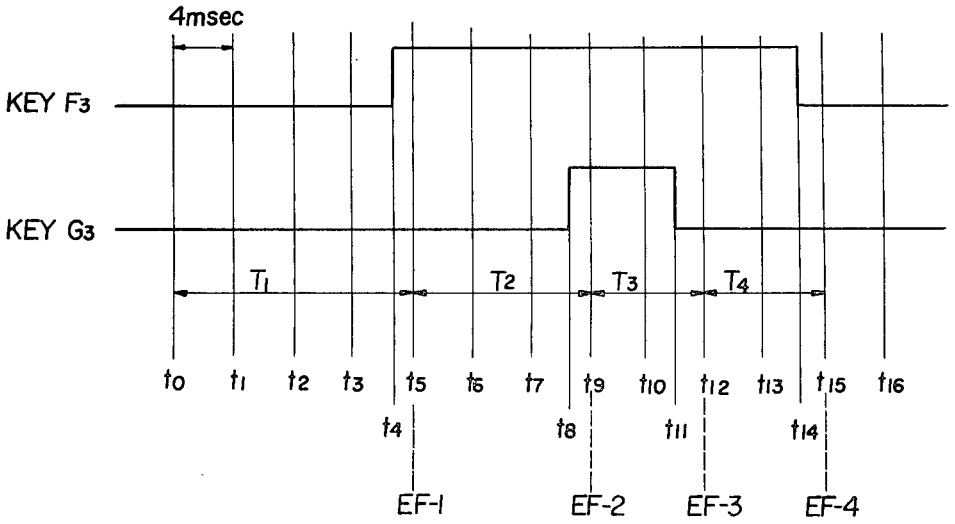
FIG.7

SOLENOID DRIVING APPARATUS FOR ACTUATING KEY OF PLAYER PIANO

BACKGROUND OF THE INVENTION (1) Field of the Invention

The present invention relates generally to an automatic piano playing instrument, and more particularly to a solenoid driving apparatus for actuating keys of a player piano.

(2) Description of the Prior Art

FIG. 1 is a diagrammatic illustration of a prior art automatic piano playing instrument showing briefly a construction thereof. Such instrument is shown in the U.S. Pat. No. 4,132,141. In the figure, a reference numeral 1 denotes a key of a piano which is pivoted about a fulcrum 2 in such a way that an end portion 1*b* of the key is moved upward when an operating portion 1*a* opposite to the end portion 1*b* is depressed downward. The upward movement of the end portion 1*b* is transmitted to a piano action 3 which actuates a hammer 4 to strike a string 5.

By depressing the operating portion 1*a* of the key 1, a key switch 8 comprising a flexible spring 6 and a contact point 7 is turned on. Musical tones produced by the string 5 are received by a microphone 9 for the transference thereof to a record control circuit 10, one or two microphones 9 being commonly used for one piano. The record control circuit 10 detects whether each of all the keys 1 is depressed or not sequentially in response to an output from the corresponding key switch 8 thereby periodically delivering a key data which represents each key is depressed or not to such a data recorder 11 as a cassette tape recorder. Simultaneously, the record control circuit 10 detects the strength of a key striking motion in accordance with an output from the microphone 9 thereby delivering a key striking strength data representative of the strength of a key striking motion to the data recorder 11. The data recorder 11 is activated (or the magnetic tape thereof is started to move) at the start of playing the piano in order to record sequentially the aforementioned key data and key striking strength data.

The above steps are concerned with the recording of a musical performance data generated by a player. Conversely, when the recorded musical performance data is requested to be reproduced, the data recorder 11 transfers sequentially in real time the recorded data to a reproduction logical circuit 12. In the circuit 12, a key data and a key striking strength data are reproduced in accordance with the data from the data recorder 11 for the delivery to a solenoid driving circuit 13. The solenoid driving circuit 13 generates a solenoid driving signal in accordance with the key data and key striking strength data supplied thereto, the solenoid driving signal being supplied to a corresponding solenoid 14. Then, the plunger 14*a* of the solenoid 14 is driven upward with a speed corresponding to the key striking strength data, thereby urging the end portion 1*b* of the key 1 to move upward with the upper end of the plunger 14*a* being in contact relation to the bottom surface of the key 1 adjacent to the end portion 1*b*. The upward displacement of the end portion 1*b* is transformed via the piano action 3 into the striking motion of the hammer 4, thereby striking the string 5 with a force corresponding to the key striking strength data.

One of typical conventional automatic piano playing instruments or player pianos has been described above in brief. In such automatic piano playing instruments, however, an energy to be applied with solenoid 14 is determined by the magnitude of key striking strength data, and the key striking strength data is determined by the tone magnitude which is pick up by the microphone 9.

Therefore, paticularly when a plurality of keys are concurrently depressed, the key striking strength data for plural keys are determined at the same magnitude, and accordingly respective key striking strength data cannot correspond to respective key striking strength. Consequently, it is difficult to reproduce the musical performance data with high fidelity.

Further, each solenoid is driven in accordance with the key striking strength data, however, energy which are required at respective keys are different from each other when the respective keys are driven by the same key striking strength.

That is, according to characteristics of solenoids and actions, positions of solenoids, and the kind of keys (white keys or black keys, and higher pitch keys or lower pitch keys), energy required when the keys are driven by the same strength are different from each other.

Therefore, also due to this fact, it is difficult to reproduce the musical performance data with high fidelity.

SUMMARY OF THE INVENTION

It is therefore a principal object of the present invention to provide a novel solenoid driving apparatus for actuating keys of a player piano in which respective key striking strength data can be applied to respective solenoids of keys, so that musical tones can be reproduced correctly.

It is another object of the present invention to provide the solenoid driving apparatus for actuating keys of a player piano in which key striking strength data at the time of musical performance can be compensated for high fidelity reproduction.

In a preferred example of the present invention which will be described hereinunder in detail, the solenoid driving apparatus for actuating keys of a player piano comprises: a plurality of keys; a plurality of solenoids each respectively provided on respective plurality of keys; first data generating means for generating a first key striking strength data corresponding to key striking strength of a depressed key; second data generating means for generating a data designating the depressed key; first conversion means for converting the first key striking strength data into a second key striking strength data so as to make the latter data in linear proportion to an operating speed of the solenoid; third data generating means for generating a solenoid driving data in accordance with the second key striking strength data; and solenoid driving means for driving a solenoid in order to actuate the corresponding key designated by the data from the second data generating means, with energy corresponding to the solenoid driving data being applied to the solenoid.

The foregoing and other objects, the features and the advantages of the present invention will be pointed out in, or apparent from, the following description of the preferred embodiments together with the accompanying drawings.

BRIEF DESCRIPTION OF THE DRAWINGS

FIG. 5 shows is a construction of an event frame EF incorporated into the present invention;

FIGS. 6*a* through 6*d* show respectively examples of a format of the event frame EF;

FIG. 7 is a timing chart showing an example of a key operation;

DETAILED DESCRIPTION OF THE PREFERRED EMBODIMENT

Figure 2:
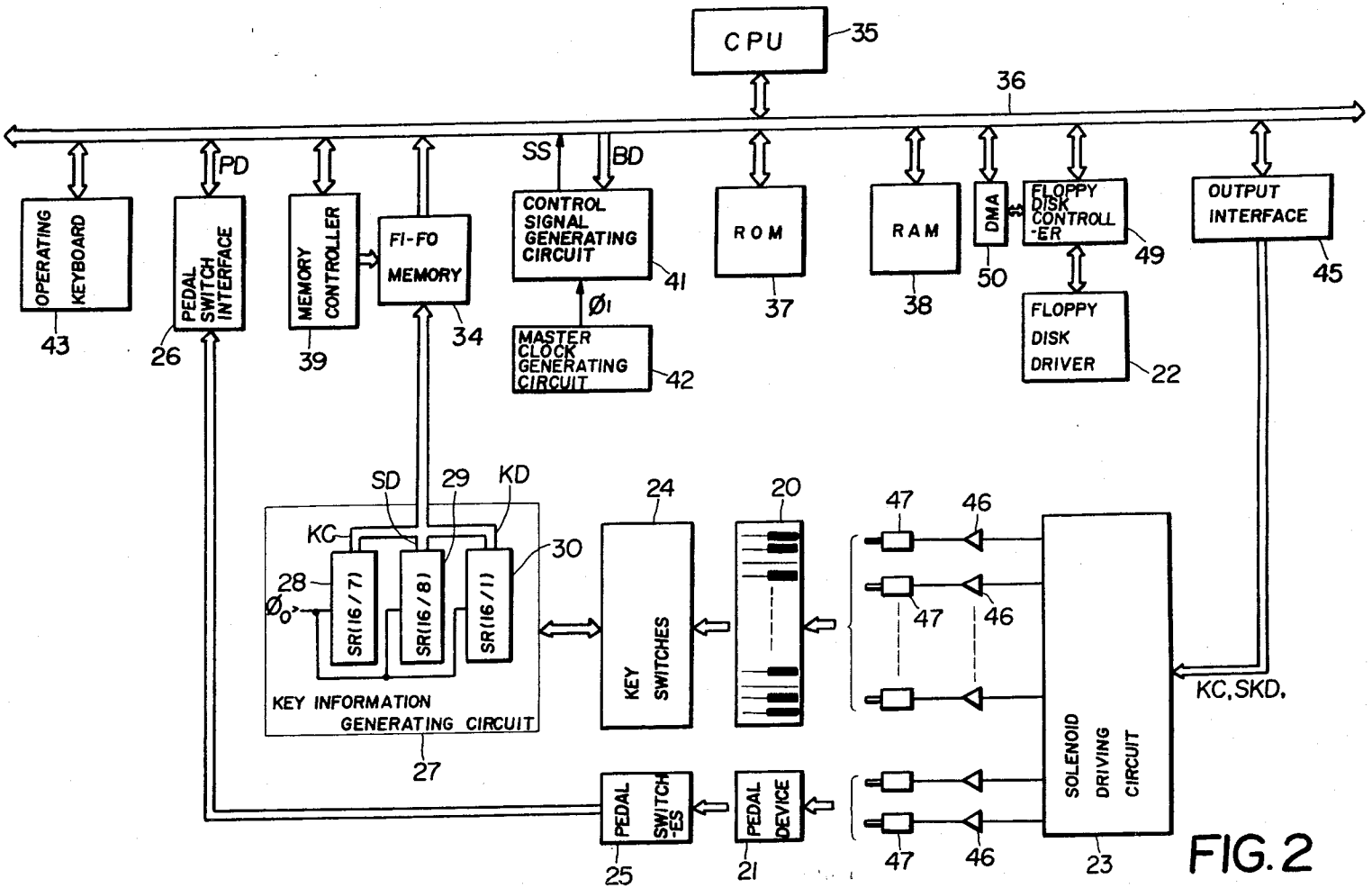
FIG. 2 is a block diagram showing an arrangement of an embodiment according to the present invention.

A preferred embodiment according to the invention will now be described with reference to the accompanying drawings. Referring now to FIG. 2 which shows a schematic block diagram illustrating an arrangement of the automatic piano playing instrument, a brief description thereof is first given.

Figure 1:
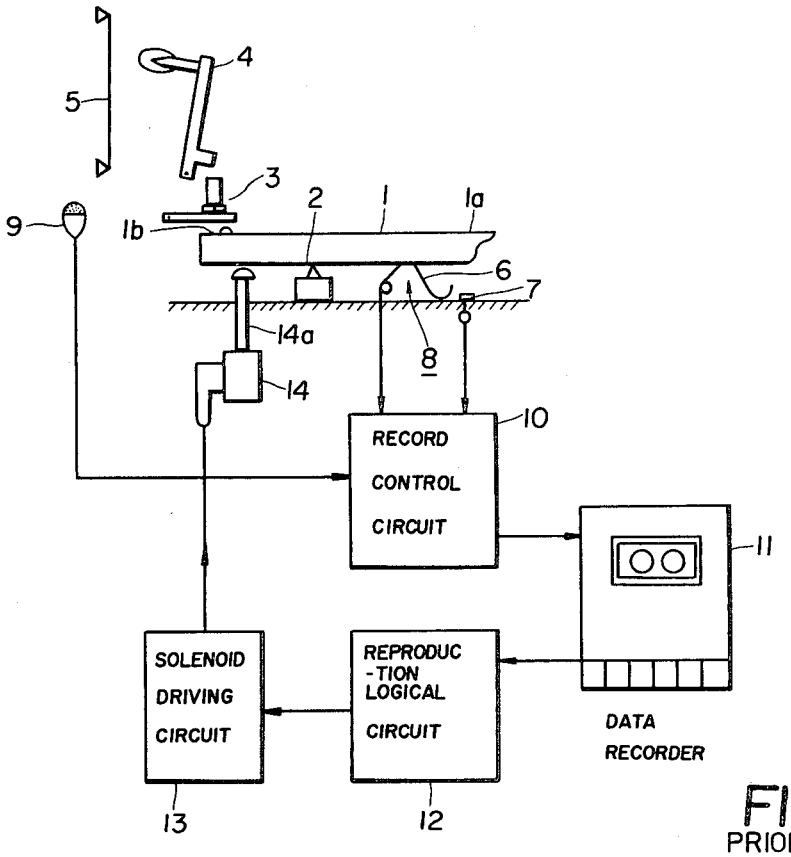
FIG. 1 PRIOR ART
FIG. 1 is a diagrammatic illustration showing a brief construction of a prior art automatic piano playing instrument.

Each key of a keyboard 20 is provided with two key switches and a solenoid 47 (similar to that shown in FIG. 1 by a reference numeral 14) for driving a key. The respective two key switches are actuated in a different timing upon depression or release of the key (as described later in detail). Damper, and sostenuto pedals (shown collectively as a pedal device 21) of the piano are provided with respective pedal switches 25 and solenoids 47 for actuating the pedals. The depression and release of the key is detected in accordance with the output from the corresponding key switch, the speed of movement of the key, i.e., the key striking strength is detected in accordance with the time interval between the actuation of the two key switches, and the depression and release of the pedal is detected in accordance with the output from the corresponding pedal switches. Data obtained from the operation of the above key and pedal switches is used for generating a musical performance data which is written to available tracks of a floppy disk mounted on a floppy disk driver 22. In order to reproduce the musical performance data (or to play a piano automatically), the musical performance data stored in the floppy disk is sequentially read out therefrom and is converted into another form suitable for being supplied to a solenoid driving circuit 23. The solenoid of each key and pedal is therefore driven in accordance with the data delivered from the solenoid driving circuit 23, thereby enabling to automatically play the piano.

The more detailed description of the automatic piano playing instrument will now be given hereinunder.

Figure 3:
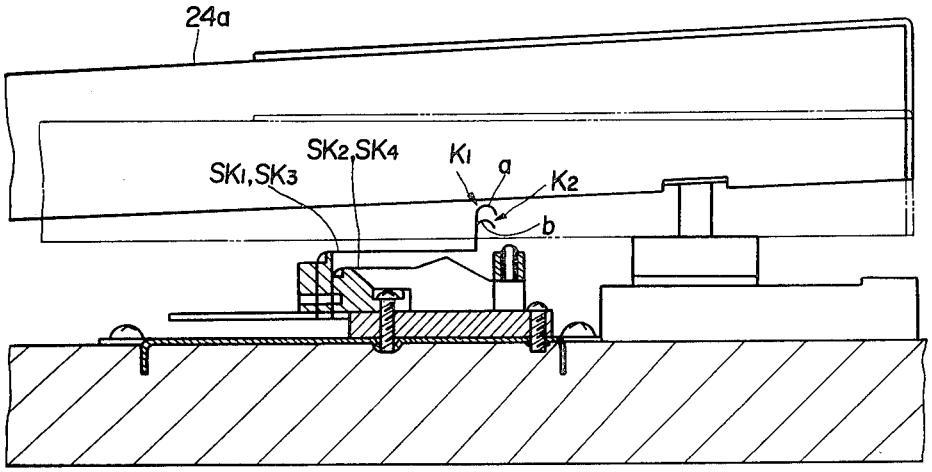
FIG. 3 is a side sectional view showing a construction of key switches $K_1$ and $K_2$ provided on each key of the piano keyboard.

In FIG. 2, key switches 24 shown as a block comprise a plurality of key switches provided to each key of the keyboard 20. Referring particularly to FIG. 3, an example of the construction of the two key switches provided to the respective single key will be described. In the figure, a reference numeral 24*a* denotes one of the key of the keyboard 20. First and second key switches K1 and K2 are arranged under the front portion of the key 24*a* in a juxtaposed relation to each other. The first and second key switches K1 and K2 comprise respective movable contacts SK1 and SK3, and respective fixed contacts SK2 and SK4 disposed under and adjacent to the contacts SK1 and SK3. The movable contacts SK1 and SK3 are fixed at one ends thereof and extending therefrom in the longitudinal direction of the key 24*a*. At the other ends of the movable contacts SK1 and SK3, there are provided contact sections (a) and (b) which are bent generally in a form of an inverted J character for engagement with the bottom of the key 24*a*. The contact section (a) is positioned at a higher level than the contact section (b), i.e., the former is positioned nearer to the bottom of the key 24*a* than the latter. As a result, when the key 24*a* is depressed, the contact section (a) is first lowered by the bottom of the key 24*a* so that it comes into contact with the fixed contact SK2 and causes the first key switch K1 to turn on, thereafter the contact section (b) is lowered by the further downward movement of the bottom of the key 24*a* so that it also comes into contact with the fixed contact SK4 and causes the second key switch K2 to turn on.

Pedal switches 25 shown in FIG. 2 comprise two pedal switches provided to each pedal of the pedal device 21, the output of each pedal switch being supplied to a pedal switch interface 26.

A key information generating circuit 27 scans each key switches K1 and K2 of the key switches 24 in order to detect on-off states thereof, and generates key information in accordance with the on-off states of the key switches K1 and K2. The key information is composed of a key code KC (7 bits), key striking strength data SD (8 bits), and key depression acknowledging code KD (1 bit) More in detail, the key information generating circuit 27 comprises three shift registers 28 (16 stages/7 bits), 29 (16 stages/8 bits) and 30 (16 stages/1 bit), each register being driven and controlled by a clock pulse $\phi_0$. When any one (hereinafter referred to as key A where applicable) of the keys is depressed and the first key switch K1 corresponding to the key A is turned on, the key code KC corresponding to the key A is written to an empty stage (assuming here that the empty stage is the tenth stage among the sixteen stages) of the shift register 28. After the first key switch K1 of the key A is turned on, the time interval until the second key switch K2 is turned on is measured. The measured result is used as the key striking strength data SD and is written to the tenth stage of the shift register 29. Concurrently when the second key switch K2 of the key A is turned on, the key depression acknowledging code KD (a logical signal of "1") is written to the tenth stage of the shift register 30. When the key A is released and the first key switch K1 is restored to an off state, all of the contents in the tenth stages of each shift register 28 through 30 are cleared (or made "0").

As readily understood from the construction of the shift registers 28, 29 and 30 each having sixteen stages, the key information generating circuit 27 has a capability to assign the key information of sixteen keys at the maximum to respective stages of the shift registers 28 through 30. The key information thus assigned to respective stages of the shift registers 28 through 30 is transferred to a first-in first-out memory FIFO 34 in a time division manner under control of the aforementioned clock pulse $\phi_0$. In order to obtain the key striking strength data SD, the following process is carried out.

Taking the same situation as one example in which the key A is depressed and the first key switch K1 is turned on, then a logical value "1" is sequentially added at each of certain time intervals to the tenth stage of the shift register 29. (All of the contents of the tenth stage of the shift register 29 are previously set to be "0" at the instant the first key switch K1 of the key A is turned on). The above addition of "1" is terminated at the time the second key switch K2 is turned on, thereafter during the period the key A is retained being depressed, the added result in the tenth stage of the shift register 29 is outputted as the key striking strength data SD. The contents of the shift register 29, until the second key switch K2 is turned on, does not indicate the correct key striking strength data SD, but the contents merely represent an intermediately measured time interval between the actuation of both key switches K1 and K2. The correct key striking strength data SD can only be outputted from the shift register 29 only after the second key switch K2 is turned on, or in other words only after the key depression acknowledging code KD is rendered to be "1".

A central processing unit 35 (an abbreviation CPU is used hereinafter) controls all the other devices connected thereto via a bus line 36 in accordance with a program to perform specified activities described later.

Figure 4:
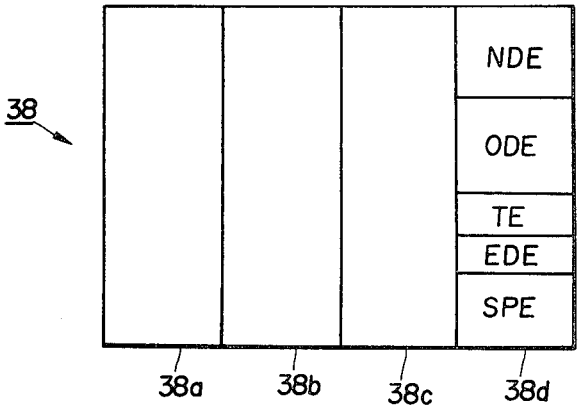
FIG. 4 shows a memory map of the RAM 38 illustrated in FIG. 2.

A ROM (Read-only Memory) 37 is a storage device in which programs for use in the CPU 35, conversion and correction tables for key striking strength data described later, are stored. A RAM (Random Access Memory) 38 as best shown in FIG. 4 has a capacity of 16 K words and is divided into four areas 38*a* through 38*d*, each having a storage capacity of 4K words. The areas 38*a* through 38*c* are used for serving as buffer memories when a read/write operation for the floppy disk is performed, while the area 38*d* is used for serving as a work area.

The FIFO memory 34 is constructed as a 16 × 16 bit first-in first-out memory, the read/write operation of which is controlled by a memory controller 39. Upon receipt of a write command from the CPU 35, the memory controller 39 makes the FIFO memory 34 in an enable state for a write operation. Thus, all the contents contained in the shift registers 28 through 30 of the key information generating circuit 27 are transferred to and written onto the FIFO memory 34 in synchronization with the clock pulse $\phi_0$. Similarly, upon receipt of a read command from the CPU 35, the memory controller 39 makes the FIFO memory 34 in another enable state for a read operation. Thus, all the contents stored in the FIFO memory 34 are transferred to and written onto a new data area NDE of the area 38*d* of the RAM 38. The reason of the insertion of the FIFO memory 34 between the key information generating circuit 27 and the bus line 36 is originated from the fact that the CPU 35 and key information generating circuit 27 are independently controlled by different (or not synchronized) clock pulses.

The pedal switch interface 26 is a circuit which generates a pedal data PD in correspondence with a detected on/off state of each pedal switch of the pedal switches 25.

A control signal generating circuit 41 counts a 2 MHz clock pulse $\phi_1$ supplied from a master clock generating circuit 42 in accordance with a repetition data BD from the CPU 35, thereby generating a control signal SS which is delivered to the CPU 35 via the bus line 36. The time interval of the control signal SS is generally determined to be 4 ms (mil seconds), however, other time intervals such as 3.5 ms, 3 ms, or 200 μS (micro seconds) may be used when occasion demands.

An operating keyboard 43 comprises a start switch, a stop switch, write/read command switches for the floppy disk driver 22, numeric character keys for identifying the code of a music, and other similar levers or buttons on the keyboard to be depressed manually, the output from each switch, key or the like being encoded and transferred to the bus line 36.

The solenoid driving circuit 23 generates a solenoid driving signal in accordance with a solenoid driving data SKD transferred from the CPU 35 via the bus line 36 and an output interface 45, the solenoid driving signal having a constant time interval between each pulse, the width of which varies in accordance with the solenoid driving data SKD. The solenoid driving signal is supplied via an appropriate amplifier 46 to a solenoid 47 which is identified by the key code KC or pedal data PD transferred from the CPU 35.

Next, the operation of the automatic piano playing instrument thus constructed will be described hereinunder.

(I) Musical Performance Data Recording

A musical performance data to be produced by a player is stored in the floppy disk mounted on the floppy disk driver 22 in such a way as in the following. The player actuates the write command switch on the operating keyboard 43 and then depresses the start switch in order to make the automatic piano playing instrument ready for being played. The player can then play music in a conventional way by using keys and pedals of the keyboard 20 and pedal device 21. When a first musical program is completed, the player depresses the stop switch on the operating keyboard 43. Similarly, when a second musical program is desired to be carried out, the player must depress the start switch again prior to the musical performance, and depresses the stop switch after completion of the second program.

Upon depression of the start switch, the CPU 35 delivers the repetition data BD instructing the control signal generating circuit 41 to generate the control signal SS having a 4 ms time interval. The CPU 35 controls the following processes upon reception of each control signal SS.

(a) First, a write instruction is supplied from the CPU 35 to the memory controller 39 to initiate the transfer operation of all the contents of the shift registers 28 through 30 in the key information generating circuit 27 to the FIFO memory 34.

(b) The transferred data in the FIFO memory 34 is then written to the new data area NDE within the area 38*d* of the RAM 38.

(c) At the next stage, the pedal data PD from the pedal switch interface 26 is transferred and written to the new data area NDE within the same area 38*d* of the RAM 38.

(d) A logical value "1" is added to the contents of the data stored in the timer area TE within the area 38*d* of the RAM 38. What this operation means will be described later more specifically.

(e) Next, the data stored in the new data area NDE of the RAM 38 is compared with that in an old data area ODE in order that a change (hereinafter referred to as "event") can be detected when the performing conditions, i.e., the depression and release of the key and pedal, of the keyboard 20 and pedal device 21 differ from the previous conditions. The old data area ODE functions to store temporarily the contents of the shift registers 28 through 30 and the pedal data PD, both of them having previously been transferred thereto in response to the preceding control signal SS generated 4 ms before.

The detailed description of the event detection is given hereinunder. First, with respect to the pedal device 21, an event is detected when there is any change in the pedal data PD. However, with respect to the keyboard 20, an event is not detected when only the first key switch K1 is turned on, but with the condition that the second key switch K2 is also turned on, i.e., when the key depression acknowledging code KD is rendered to be "1", an event is detected. More precisely an event is detected at the instant when a new control signal SS is generated after generation of the "1" signal of the key depression acknowledging code KD. In the case of a key release, an event is detected when the first key switch K1 is turned off with the result that the key code KC, key striking strength data SD, and key depression acknowledging code KD are restored to "0" in the contents. More precisely, an event is detected at the instant when a new control signal SS is generated after the first key switch K1 is turned off.

(f) In the case when the event is not detected during the above stage (e), the contents of the new data area NDE of the RAM 38 is transferred to the old data area ODE to terminate a processing of the consecutive stages described above and to wait for the next control signal SS.

(g) In the case when the event is detected during the above stage (e), a format comprising a series of data (hereinafter designated as an event frame EF) specifically shown in FIG. 5 is made and written to the area 38*a* of the RAM 38. The event frame EF is described later in detail.

(h) Thereafter, the contents of the timer area TE is cleared in case the event is detected.

(i) Then, the contents of the new data area NDE is transferred to the old data area ODE to terminate a processing of the consecutive stages described above and to wait for the next control signal SS.

The operations to be carried out every time the control signal SS is generated have been described with reference to the control by the CPU 35. Now, the data to be stored in the timer area TE as well as the event frame EF is discussed below.

The data stored in the timer area TE is cleared every time an event is detected as described in the above stage (h), and a logical value "1" is added to the timer area TE every time the subsequent control signal SS is generated. The data stored in the timer area TE at the time of the generation of the control signal SS indicates the time period from the instant of the generation of the previous event to the instant of the generation of the next event, thus the time period being an integral multiple of the time interval 4 ms of the control signal SS.

The event frame EF as specifically shown in FIG. 5 comprises a first word number data WD1, timer data TD, event data ED, and second word number data WD2. The description of these data is given in this order hereinunder.

(a) First Word Number Data WD1

The contents of the first word number data WD1 is indicative of a total of the number of words of the timer data TD and event data ED.

(b) Timer Data TD

The timer data TD stored in the timer area TE of the RAM 38, at the time of the processing of the above stage (g), indicates a time period from the generation of the previous event to that of the present event. The timer data TD is formed to have a two-word arrangement.

(c) Event Data ED

The event data ED is the data concerning a key or pedal for which an event is detected. When a key is newly depressed and the second key switch K2 is turned on, an event data ED of a two-word arrangement is generated which includes, as shown in FIG. 6(*a*), a key code KC (7 bits), and key striking strength data SD (8 bits) of the newly depressed key, and key-on code or key depression acknowledging code "1". As previously described, the key code KC and key striking strength data SD are located in the new data area NDE. When a key is released, as shown in FIG. 6(*b*), an event data ED of a one-word arrangement is generated which includes a key code KC of the released key, and key-off code "0". When any one of the pedals of the pedal device 21 is turned on, as shown in FIG. 6(*c*), an event data ED of one-word arrangement is generated which includes a pedal data PD, and pedal-on code "1". While on the other hand, when a pedal is turned off from its previous on-state, as shown in FIG. 6(*d*), an event data ED of a one-word arrangement is generated which includes a pedal data PD, and pedal-off code "0". Further, when two keys are depressed simultaneously at a time, an event data ED having two event data each having a similar format as shown in FIG. 6(*a*) is generated. Similarly, when a key and a pedal are depressed simultaneously an event data ED having those shown in FIG. 6(*a*) and 6(*c*) is generated. The timer data TD and event data ED are designated collectively as a musical performance data, as already described.

(d) Second Word Number Data WD2

This data is identical in the contents to the first word number data WD1. Thus, in this preferred embodiment, the same data indicative of the same word number is allocated both at the start and end of the format of the event frame EF.

A more concrete description of the process is given hereinunder in which the event frame EF is transferred and written to the area 38*a* of the RAM 38.

It is assumed here for the exemplary purpose of explanation that in FIG. 7 the start switch is actuated to make it on at a timing $t_0$; the key switch K2 of a key F3 (corresponding to a note F of the third octave) is turned on at a timing $t_4$; the key switch K2 of a key G3 (corresponding to a note G of the third octave) is turned on at a timing $t_8$; the key switch K1 of the key G3 is turned off at a timing $t_{11}$; and the key switch K1 of the key F3 is turned off at a timing $t_{14}$.

Figure 8:
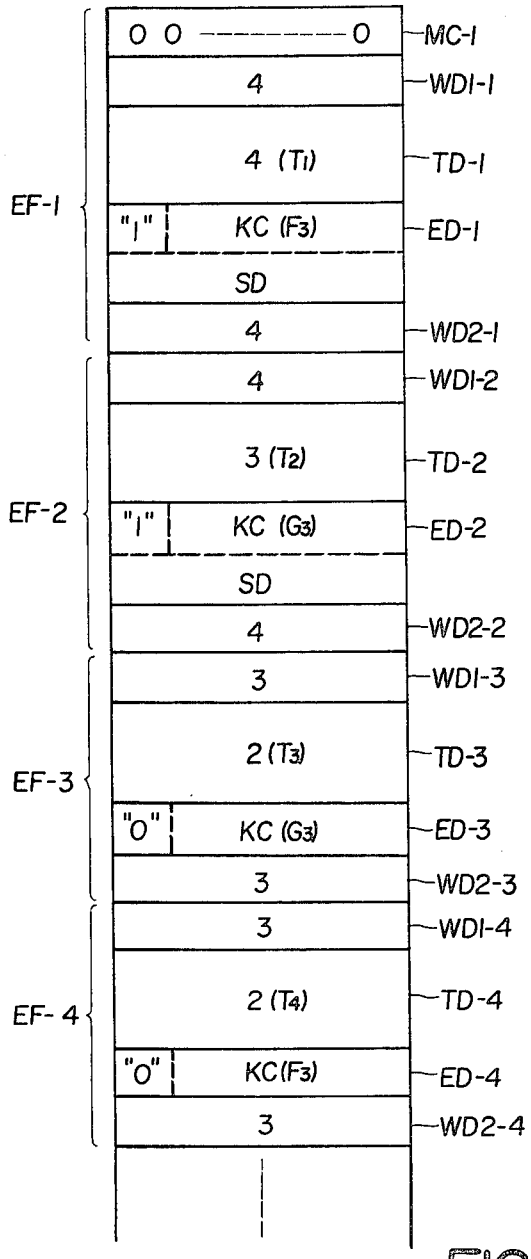
FIG. 8 shows a sequence of data stored in the RAM 38 in FIG. 2 which data is generated in response to the key operation shown in FIG. 7.

After the start switch is turned on at the timing $t_0$, the control signals SS are generated at 4 ms time intervals at the timings $t_1$, $t_2$ and $t_3$. Since there is no change of the key depression during the period from the timing $t_1$ to the timing $t_3$, an event is not detected. However, at a timing $t_5$ an event is detected because a state showing the depression of the key F3 appears at that timing which differs from that at the timing $t_3$. As a result, an event frame EF-1 shown in FIG. 8 is written to the area 38*a* of the RAM 38. Thus, the contents of the timer data TD-1 is "4" in decimal notation (corresponding to the time period T1 shown in FIG. 7), the contents of the event data ED-1 are those of the key code KC, key striking strength data SD, both of the key F3, and key-on code "1", and the contents of the first and second word number data WD1-1 and WD2-1 are both "4" in decimal notation.

Although the process of event detection is also carried out at timings $t_6$ and $t_7$, no event is detected at the timings $t_6$ and $t_7$, to thereby generating no event frame EF. Under the event detection process at a timing $t_9$, an event is detected due to the change of the depression state of the key G3. Therefore, an event frame EF-2 shown in FIG. 8 is written to the area 38*a* of the RAM 38 following the location where the event frame EF-1 has been stored. The similar process is followed repeatedly, and at a timing $t_{12}$ an event is detected due to the change of the depression state of the key G3 so that an event frame EF-3 shown in FIG. 8 is written to the area 38*a* of the RAM 38. Similarly, at a timing $t_{15}$ an event is detected due to the change of the depression state of the key F3 so that an event frame EF-4 shown in FIG. 8 is written to the area 38*a*.

As appreciated from the above embodiment, every time an event is detected the musical performance data (timer data TD and event data ED) is recorded to the area 38*a* of the RAM 38 as a format of an event frame EF. After the area 38*a* is completely filled up with the event frames EF, the vacant area 38*b* is used for storing the succeeding event frames EF. In addition, the data stored in the area 38*a* is supplied to the floppy disk driver 22 and is sequentially written to the available tracks of the floppy disk via the floppy disk controller 49 under the control of a direct memory access controller 50. In the case when the area 38*b* is completely filled up, the event frame EF is then stored in the new area 38*c*, and the data stored in the old area 38*b* is transferred and written to the predetermined tracks of the floppy disk. The areas 38*a*, 38*b* and 38*c* are thus cyclically utilized. The above description so far has been concerned in the processes how the musical performance data obtained from the performance of a piano player is recorded and stored in the floppy disk mounted on the floppy disk driver 22.

In the course of storing various musical performance data of a plurality of musical programs in the tracks of the floppy disk, there is provided an additional data processing stage for the convenience of easy access to the musical performance data of a specified musical program.

Figure 9:
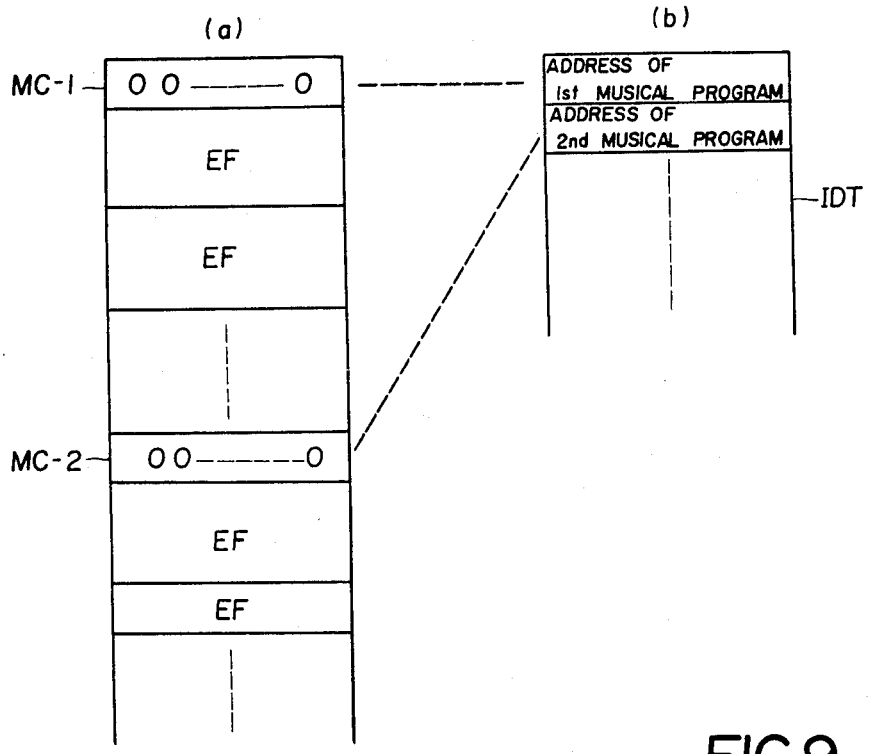
FIGS. 9*a* and 9*b* are diagrammatic illustration relating to an index table IDT for use in identifying the number of a musical program.

More specifically, upon depression of the start switch, a musical program intermediate code MC-1, all of the digits of which are composed of a bit "0" as shown in FIG. 9(*a*), is written to the first position of a location in the area 38*a* of the RAM 38. Thereafter, succeeding the program intermediate code MC-1, the event frames EF are sequentially written to the area 38*a* every time an event is detected. A reference character MC-1 used in FIG. 8 also shows such a program intermediate code. After completing the performance of the first musical program, the player again depresses the start switch to perform a second musical program. Similarly, a program intermediate code MC-2 is written to the area 38*a* (or to the area 38*b* or 38*c*), and the event frames EF are written thereafter. The same process is repeated when the following musical programs, third, fourth, and so on are repeated. In this case, the depression of the stop switch by the player after completion of each musical program causes the data stored in the areas 38*a* through 38*c* to be written to the tracks of the floppy disk of the floppy disk driver 22. Then, addresses each identifying a specific location in the tracks of the floppy disk of the floppy disk driver 22 and corresponding to the respective program intermediate code are written to a specified track in the floppy disk, sequentially in the order starting from the first musical program. As a result, an index table IDT as shown in FIG. 9(*b*) is formed to be stored in the floppy disk. Thus, in this embodiment, an easy access to a specified musical program is attained by placing the program intermediate code at the top of the event frames EF of each musical program and by forming the index table IDT in the floppy disk.

(II) Musical Performance Data Reproducing or Automatic Piano Playing

The process for storing a musical performance data in the floppy disk mounted on the floppy disk driver 22 has been described under the title (I) "Musical Performance Data Recording". Next, the process for reading out thus stored musical performance data and automatically playing the piano in accordance with the stored data will be described hereinunder.

The operator first actuates the read command switch on the operating keyboard 43, and specifies the musical program number allocated to each musical program by depressing the numerical character keys, and thereafter the operator makes the depression of the start switch.

Upon depression of the start switch, the CPU 35 reads out the address (that of the program intermediate code), corresponding to the musical program number specified by the depression of the numerical character keys, from the index table IDT (refer to FIG. 9(*b*)) stored in the tracks of the floppy disk mounted on the floppy disk driver 22. The read out address is again supplied through the floppy disk controller 49 to the floppy disk driver 22 in order to transfer the data stored in the location after the read-out address to the areas 38*a* through 38*c* by a capacity of 12K words. After the above process, the CPU 35 generates the repetition data BD designating a 4 ms time interval, as similar to the process described in the data recording processes, so as to supply it to the control signal generating circuit 41. The control signal generating circuit 41 accordingly generates the control signals SS of 4 ms time intervals to supply them to the CPU 35. The data transferred to the areas 38*a* through 38*c* is then processed sequentially by the control signals SS under the control of CPU 35. This data processing will be described hereinunder assuming, for the purpose of convenience, that as shown in FIG. 8 the program intermediate code MC-1, event frames EF-1, EF-2 . . . are stored in the area 38*a* at from the first position of the location thereof in the above order.

After supplying the repetition data BD designating a 4 ms time interval to the control signal generating circuit 41, the CPU 35 reads out the first word number data WD1-1 (the contents being "4") and timer data TD-1 (the contents being "4") from the area 38*a* of the RAM 38 to transfer both of them respectively to a temporary storage area SPE and timer area TE in the area 38*d*. The contents of the timer area TE is subtracted by "1" and the result is again written to the timer area TE, every time the control signal SS is generated. At the time instant when the contents of the timer area TE becomes "0", that is, after the lapse of a time duration T1 shown specifically in FIG. 7, the following processes are carried out.

(a) The number of words "4" in the first word number data WD1-1 is subtracted by the number of words "2" in the timer data TD.

(b) The subtracted result, which indicates the number of words "2" of the event data ED-1 in FIG. 8, determines the number of data words to be read out of the area 38*a*. The read-out data, i.e., the event data ED-1 is written to the event data area EDE in the area 38*d*.

(c) The first word data number WD1-2 (the contents is "4") and timer data TD-2 (the contents is "3") as shown in FIG. 8 are read out of the area 38*a* to respectively write them to the temporary storage area SPE and timer area TE in the area 38*d*.

Upon completion of the write operation of the event data ED-1 to the event data area EDE in the area 38*d* (the process described in the above (b)), a solenoid driving data SKD is formed in compliance with the event data ED-1 (i.e., a key code KC corresponding to the key F3, key striking strength data SD, and key-on code "1"), and is supplied to the solenoid driving circuit 23. The solenoid driving circuit 23 generates a solenoid driving signal in accordance with the solenoid driving data SKD to supply it to the solenoid 47 corresponding to the key F3 via the amplifier 46. Thus, the key F3 is stricken with a strength responsive to the key striking strength data SD. The process for driving the solenoid 47 will be later described more specifically.

Following the process (c) above, the contents of the timer are TE (at this instant, the contents is "3") is subtracted by "1" every time the control signal SS is generated, until the contents of the timer area TE becomes "0"(i.e., after the lapse of a time duration T2 shown in FIG. 7). Thereafter, the similar processes as described above are performed:

(a) The number of words "4" in the first word number data WD1-2 is subtracted by the number of words "2" in the timer data TD.

(b) The event data ED-2 is read out of the area 38*a* in accordance with the subtracted result "2", and is written to the event data area EDE.

(c) The first word number data WD1-3 ("3") and timer data TD-3 ("2") are read out of the area 38*a* to respectively write them to the temporary storage area SPE and timer area TE.

Upon completion of the write operation of the event data ED-2 (i.e., a key code KC corresponding to the key G3, key striking strength data SD, and key-on code "1") to the event data area EDE, the solenoid 47 corresponding to the key G3 is driven in accordance with the contents of the event data ED-2.

After the lapse of a time duration T3 corresponding to the contents "2" of the timer data TD-3, the similar processes as in (a) through (c) above are performed with a result that the event data ED-3, timer data TD-4 ("2"), and first word number data WD1-4 are written to the respective event data area EDE, timer area TE, and temporary storage area SPE. Upon completion of the write operation of the event data ED-3 (i.e., a key code KC corresponding to the key G3, and key-off code "0") to the event data area EDE, the solenoid 47 corresponding to the key G3 is turned off.

The same processes are repeated to automatically play the piano. When the whole data transferred to the area 38*a* of the RAM 38 is fully read out and is reproduced automatically by the piano, the automatic playing is continued by reading out the succeeding data stored in the next area 38*b*. During the time the data in the 38*b* is read out and reproduced automatically by the piano, the empty location of the area 38*a* is filled up by reading out the following data from the tracks of the floppy disk mounted on the floppy disk driver 22 and by writing it thereto. Thus, after the automatic performance according to the data in the area 38*b* is completed, it is continued sequentially by reading out the data in the order of the areas 38*c*→38*a*→38*b*→. . . , while the write operation of the musical performance data is continued sequentially according to the order of the areas 38*b*→38*c*→38*a*→. . . , after completion of the writing operation to the area 38*a*.

It is to be noted here that although the above description has been limited to the operation originated from the actuation of the keys of the keyboard 20, the operation with respect to the pedals of the pedal device 21 may also be applied in the same way.

In the event that it is desired to change the tempo of musical performance, the repetition data BD representing such as a 3 ms or 3.5 ms time interval may be used for supplying it to the control signal generating circuit 41, in lieu of the repetition data BD representing a 4 ms time interval as above.

The process for driving the solenoid 47 in accordance with the event data ED stored in the event data area EDE will now be described below, assuming that the key F3 is driven exemplarily.

Figure 10:
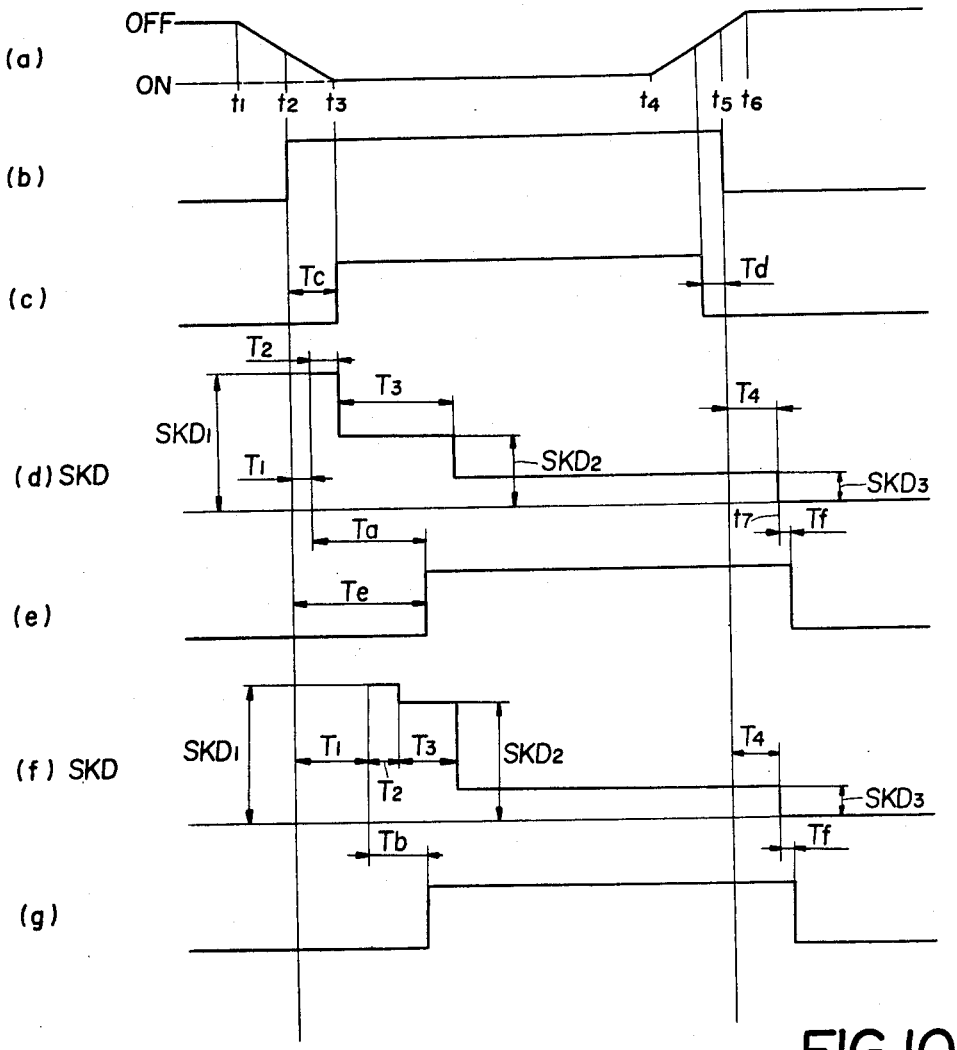
FIGS. 10(*a*) through 10(*g*) are timing charts illustrating the operation of the solenoid 47 in conjunction with the solenoid driving data.

Waveforms shown in FIGS. 10(*a*) through (*c*) have the following meanings respectively.

(a) A waveform representing an on/off operation of the key F3.

In the figure, t1 represents a time instant when the performer touches the key F3, t2 represents a time instant when the second key switch K2 turns on, that is, when the event frame EF-1 (see FIG. 8) is written to the area 38*a* of the RAM 38, t3 represents a time instant when the key F3 reaches the lowermost depressed position, t4 represents a time instant when the performer starts releasing the key F3, t5 represents a time instant when the first key switch K1 turns off, that is, when the event frame EF-4 (see FIG. 8) is written to the area 38*a* of the RAM 38, and t6 represents a time instant when the performer completely releases the key F3.

(b) A waveform representing a time period from the detections of key-on to key-off of the key F3, that is, representing a time period during which the associated circuit operates to indicate the key-on of the key F3.

(c) A waveform representing a time period during which real musical tones (musical tones generated by striking the strings) are being generated.

That is, a real musical tone is generated when the key F3 reaches substantially the lowermost depressed position, and thereafter the real musical tone is maintained to be generated continuously while the key F3 is being depressed, and the musical tone is terminated in the course of releasing the key F3 or at about the intermediate position of the depth of key depression.

The above three waveforms indicate respectively a particular operational state during musical performance data recording. In reproducing the musical performance data stored in the floppy disk in accordance with the key operations shown in FIG. 10 (*a*) above, the event data ED-1 is written to the event data area EDE at the time t2, and the event data ED-4 is written to the event data area EDE at the time t5. For the purpose of brevity, the same drawings as FIGS. 10 (*a*) to 10 (*c*) have been used for explaining the operations of both data recording and reproducing, although the time axis shown in the drawings must necessarily differ in each operation.

First, when the event data ED-1 is written to the event data area EDE at the time t2, the contents of the key striking strength data SD (of the key F3) in the event data ED-1 is transformed in compliance with a conversion table for the key striking strength data stored in the ROM 37. The reason to transform the key striking strength data SD is in the following:

The key striking strength data SD has the contents proportionate to key striking strength exerted by the performer, while the plunger response speed of the solenoid 47 does not follow linearly to the pulse width of the solenoid driving signal. In other words, although the solenoid driving signal with a pulse width proportionate to the key striking strength data SD is supplied to the solenoid 47, the plunger response speed will not become in proper proportion to the key striking strength. The key striking strength data SD must therefore be transformed in order to obtain the plunger response speed correctly corresponding to the key striking strength data SD. To this end, the conversion table for the key striking strength data is provided wherein data corresponding to each value of the key striking strength data SD (hereinafter referred to as key striking strength data SD') is stored. The conversion table for the key striking strength data may include, for example, five separate tables respectively for each stepwise changing for sound volume, which tables are independently accessible by a sound volume setting switch in the operating keyboard 43.

Next, the converted key striking strength data SD' is further adjusted with the aid of a correction table written to the RAM 37 for the key striking strength data. The reason to adjust the key striking strength data SD' is as follows:

(a) It is necessary to change the key striking strength data based on whether the black or white key is designated because forces required for actuating white key and black key differ from each other due to the different weight between the keys.

(b) Some cases occur in which all of the solenoids 47, 47 . . . can not be aligned in a straight line due to a restricted space for accommodating the solenoids, and sometimes the solenoids 47 are aligned in zigzag arrangement. In such occasions, the key striking strength data must be compensated in accordance with the position of the solenoids 47.

(c) Different key driving forces are required based on whether higher pitch key or lower pitch key is designated. Thus, when solenoid driving signal with the same pulse width is applied to respective solenoids 47 corresponding to higher and lower pitches, the response speed of the former solenoid 47 is higher than that of the latter solenoid 47. Therefore, it is necessary to compensate the difference of the response speed.

The correction table for the key striking strength data is provided in order to effect the above compensation, and stores correction data (for example, "+1", "0", "−1" . . . ) corresponding to respective key codes KC. The key striking strength data SD' described above is adjusted in accordance with the correction data corresponding to the key code KC of the key F3. The adjusted data is referred to as a key striking strength data HSD. Both conversion and correction tables for the key striking strength data have been prepared basing upon the experimental results.

Basing upon the key striking strength data HSD, the solenoid driving data SKD is generated, the contents of which varies stepwise from time to time as shown in FIG. 10 (*d*) or (*f*). FIG. 10 (*d*) shows the solenoid driving data SKD in case a key striking strength data HSD has a small value (or weaker sound), and FIG. 10 (*f*) shows the solenoid driving data SKD in case a key striking strength data HSD has a large value (or stronger sound). The solenoid driving data SKD is supplied, together with the key code KC (corresponding to the key F3) in the event data area EDE, to the solenoid driving circuit 23 via the output interface 45. The solenoid driving circuit 23 generates as previously described the solenoid driving signal having a constant time interval and a pulse width corresponding to the respective solenoid driving data SKD, the solenoid driving signal being in turn supplied through the amplifier 46 to the solenoid 47 provided at the key F3. Thus, the key F3 is actuated at a strength corresponding to the key striking strength data SD in the event data ED-1 to thereby produce a musical sound. After a certain time delay of T4 (FIG. 10 (*d*), (*f*)) from the time instant t5 when the event data ED-4 is written to the event data area EDE, the solenoid driving data SKD turns to "0" so that the solenoid driving signal having been applied to the key F3 turns off. The timings of producing a musical tone for the key F3 is shown in FIG. 10 (*e*), with the solenoid driving data SKD shown in FIG. 10 (*d*) being applied to the solenoid driving circuit 23, whereas timings of producing a musical tone for the key F3 is shown in FIG. 10 (*g*), with the solenoid driving data SKD shown in FIG. 10 (*f*) being applied to the solenoid driving circuit 23.

Time periods T1 through T4 and data SKD1 through SKD3 used in conjunction with the solenoid driving data SKD shown in FIGS. 10 (*d*) and (*f*) are explained in the following:

T1: an on-delay time period

The on-delay time period T1 is a time period required for compensating for the difference of response time of the solenoid 47 (or more precisely response time of the plunger thereof) which changes its response time depending upon the degree of musical tone strength. That is, a large response time (time period Ta in FIG. 10 (*e*)) of the solenoid 47 is necessary for a weaker sound, and hence a longer time period is required for producing a real musical tone after the solenoid driving data SKD is outputted to the solenoid driving circuit 23. Conversely, a short response time (time period Tb in FIG. 10 (*g*)) of the solenoid 47 will suffice for a stronger sound, and hence a shorter time period is required for producing a real musical tone after the solenoid driving data SKD is outputted to the solenoid driving circuit 23. Thus, it is necessary to change the time period T1 for a weaker musical tone to a shorter one, and to change the time period T1 for a stronger musical tone to a longer one. Without the above correction, if two sounds different in strength are simultaneously produced, the reproduction of these sounds results in that the weaker sound is delayed to be reproduced when compared with the stronger one.

When determining the on-delay time period T1, a time period Tc (as shown in FIG. 10 (*c*)) between the times t2 and t3 are also considered in order to compensate a time difference between those for weaker and stronger sounds. This time difference results from the different speeds of key actuation for the weaker and stronger sounds.

There are many methods of determining the on-delay time period T1. One of the methods is to provide in the ROM 37 a corelation table between the striking strength data SD and the on-delay time period T1.

SKD1: a data to be used for getting out of a statical friction

That is, the solenoid driving data SKD1 is converted to a solenoid driving signal to be supplied to the solenoid 47, whereby the plunger of the solenoid 47 is driven to a condition free from the statical friction. This data SKD1 is always constant in the sense that it has a particular value for a particular solenoid.

T2: a time period required for getting out of the statical friction

This time period is also constant in the above sense.

SKD2: a data having a value corresponding to the key striking strength data HSD

Depending upon the value of the data SKD2, the response time of the plunger of the solenoid 47, and hence the key striking strength corresponding to the solenoid 47 is determined.

T3: a time period required for the plunger of the solenoid 47 to fully emerge therefrom.

When the value of the data SKD2 is large, the response time of the plunger of the solenoid 47 is short so that the time period T3 will have a short time length. Whereas when the value of the data SKD2 is small, the response time of the plunger of the solenoid 47 is long so that the time period T3 must have a long time length.

SKD3: a data for holding the solenoid.

That is, a data for maintaining the plunger of the solenoid 47 to be emerged after it is energized.

T4: an off-delay time period.

The off-delay time period is provided for making the time duration during musical performance as shown in FIG. 10 (*c*) and the time duration during reproducing as shown in FIG. 10 (*e*) or (*g*) coincide with each other. More in detail, the musical tone during performance is generated after the lapse of Tc from the time t2 as shown in FIG. 10 (*c*), and is terminated before the time interval Td from the time t5. Whereas the musical tone during reproduction as shown in FIG. 10 (*e*) is generated after the lapse of Te from the time t2, and is terminated at the time instant delayed by a solenoid delay time Tf from the time t7 (FIG. 10 (*d*)) when the solenoid driving data SKD goes to zero. Therefore, in order to make the time durations of during performance and reproduction coincide with each other, the off-delay time period T4 is set at:

$$T4=(Te-Tc)-Td-Tf \quad (1)$$

It is to be noted that the time period T4 in this embodiment is predetermined to be a constant value.

It is also appreciated that in the solenoid driving data SKD shown in FIG. 10 (*d*) or (*f*), the data SKD1 for getting out of the statical friction has been shown as having a larger value than that of the data SKD2 having a value corresponding to the key striking strength data HSD, however, it is also possible for the data SKD1 to have a smaller value than that of the data SKD2.

What is claimed is:

1. A solenoid driving apparatus for actuating keys of a player piano comprising:

a plurality of keys;

a plurality of solenoids each respectively provided on respective said plurality of keys;

first data generating means for generating a first key striking strength data corresponding to key striking strength of a depressed key;

second data generating means for generating a data designating said depressed key;

first conversion means for converting said first key striking strength data to a second key striking strength data so as to make the latter data in linear proportion to an operating speed of said solenoid;

third data generating means for generating a solenoid driving data in accordance with said second key striking strength data; and solenoid driving means for driving a solenoid in order to actuate the corresponding key designated by said data from said second data generating means, with energy corresponding to said solenoid driving data being applied to said solenoid.

2. A solenoid driving apparatus as claimed in claim 1, wherein said solenoid driving means comprises means for pulse-width-modulating a voltage signal having a constant repetition frequency with a voltage signal corresponding to the magnitude of said solenoid driving data, whereby said solenoid is driven by said pulse-width-modulated voltage signal.

3. A solenoid driving apparatus as claimed in claim 1 or 2, wherein said third data generating means further comprises second conversion means for converting said second key striking strength data to a third key striking strength data from which said solenoid driving data is generated in order to further compensate the difference originating from the characteristics of respective keys.

4. A solenoid driving apparatus as claimed in claim 3, wherein the characteristics of said second conversion means is determined such that the difference of the characteristics between a black key and a white key is eliminated.

5. A solenoid driving apparatus as claimed in claim 3, wherein the characteristics of said second conversion means is determined such that the difference of the characteristics of keys between those having higher and lower pitch is eliminated.

6. A solenoid driving apparatus as claimed in claim 3, wherein the characteristics of said second conversion means is determined such that the difference of the characteristics among all of said plurality of keys is eliminated.

7. A solenoid driving apparatus as claimed in claim 3, further comprising sound volume setting means, whereby said first conversion means is constructed such that the conversion characteristics thereof is varied in accordance with the sound volume set by said sound volume setting means.

8. A solenoid driving apparatus as claimed in claim 3, wherein said solenoid driving data comprises a first solenoid driving data having a constant value and being supplied during a first constant time duration after the lapse of a time from turning on of said key, said time varying in accordance with said first key striking strength data; a second solenoid driving data having a value which varies in accordance with said third key striking strength data and being supplied during following said first solenoid driving data and being terminated after the lapse of a second constant time duration from said turning on of said key; and a third solenoid driving data having a constant value and being supplied following said second solenoid driving data and being terminated after the lapse of a third constant time duration from turning off of said key.

9. A solenoid driving apparatus as claimed in claim 8, wherein said time from the turning on of said key to the application of said first solenoid driving data and said value of said second solenoid driving data are set respectively longer and larger for stronger musical tones, while said time and value are set respectively shorter and smaller for weaker musical tones.

* * * * *